US009388031B2

(12) United States Patent
Schoenfelder

(10) Patent No.: US 9,388,031 B2
(45) Date of Patent: Jul. 12, 2016

(54) CLOSING TOOL

(75) Inventor: Markus Schoenfelder, Regensburg (DE)

(73) Assignee: KRONES AG, Neutraubling (DE)

( * ) Notice: Subject to any disclaimer, the term of this patent is extended or adjusted under 35 U.S.C. 154(b) by 760 days.

(21) Appl. No.: 13/404,417

(22) Filed: Feb. 24, 2012

(65) Prior Publication Data

US 2012/0227355 A1 Sep. 13, 2012

(30) Foreign Application Priority Data

Mar. 9, 2011 (DE) ..... 10 2011 005 306

(51) Int. Cl.
*B65B 7/28* (2006.01)
*B67B 3/20* (2006.01)

(52) U.S. Cl.
CPC ..... *B67B 3/2066* (2013.01); *Y10S 7/901* (2013.01); *Y10T 279/23* (2015.01)

(58) Field of Classification Search
CPC ..... B67B 3/20; B67B 3/2066; B67B 3/2086; B67B 3/2073; B67B 3/00; B67B 3/2053; B65B 7/00; B65B 7/28; B23B 31/28; B23B 2270/38; B25J 15/0273; B25J 15/0608; B25J 15/103; B65G 47/90; B65G 2201/0247
USPC ..... 53/285, 287, 331.5, 343, 317; 279/128, 279/106, 35; 294/192, 119.1, 119.2, 106; 414/737, 739
See application file for complete search history.

(56) References Cited

U.S. PATENT DOCUMENTS 871,998 A * 11/1907 Kirkegaard ..... 53/343
2,030,188 A * 2/1936 Smith ..... 279/128
3,975,886 A 8/1976 Waters
4,633,646 A * 1/1987 Ellis et al. ..... 53/331.5
4,674,264 A 6/1987 Ellis et al.
4,745,729 A * 5/1988 Bethge et al. ..... 53/331.5
5,313,765 A * 5/1994 Martin ..... 53/317
5,467,527 A * 11/1995 Zanini ..... B67B 3/2033 29/240
5,479,762 A * 1/1996 Bliss ..... B67B 3/20 53/317
5,762,391 A * 6/1998 Sumnitsch ..... H01L 21/68707 294/119.1
6,041,571 A * 3/2000 Fields et al. ..... 53/331.5
6,076,875 A * 6/2000 Neff ..... B25J 9/023 294/119.1
6,318,779 B1 * 11/2001 Hanne ..... B25B 5/061 294/119.1

(Continued)

FOREIGN PATENT DOCUMENTS

CA 2162623 A1 2/1997
CN 101811654 A 8/2010

(Continued)

OTHER PUBLICATIONS

Chinese Search Report for Application No. 2012100621949 dated Nov. 28, 2013. German Search Report for 102011005306.9, dated Oct. 28, 2011.
European Search Report for EP12151923 dated Jun. 26, 2013.

*Primary Examiner* — Gloria R Weeks
*Assistant Examiner* — Justin Citrin
(74) *Attorney, Agent, or Firm* — Marshall, Gerstein & Borun LLP

(57) ABSTRACT

A closing tool for a closing machine for placing a closure on a container, where a holding force is applied to the closure by means of a gripping device. In order to obtain a universal embodiment for the closing tool the gripping device is provided with a magnetic actuator, such as with permanent magnets, for applying the holding force.

4 Claims, 5 Drawing Sheets

(56) References Cited

U.S. PATENT DOCUMENTS

| | | | | |
|---|---|---|---|---|
| 6,386,609 | B1 * | 5/2002 | Govzman | B25J 15/0253 294/119.1 |
| 6,428,070 | B1 * | 8/2002 | Takanashi | B25B 5/06 294/119.1 |
| 6,626,476 | B1 * | 9/2003 | Govzman et al. | 294/119.1 |
| 7,445,260 | B2 * | 11/2008 | Nihei | B25J 9/1612 294/106 |
| 7,699,087 | B2 * | 4/2010 | Rogalla | B60C 25/0515 157/1.1 |
| 7,866,237 | B2 * | 1/2011 | Vesentini | B65B 7/2835 53/317 |
| 2009/0020394 | A1 * | 1/2009 | Burgmeier | 198/377.01 |
| 2010/0212259 | A1 * | 8/2010 | Knieling et al. | 53/285 |
| 2011/0180374 | A1 * | 7/2011 | Fahldieck | B65G 47/847 198/617 |
| 2012/0024668 | A1 * | 2/2012 | Linke | B29C 49/4205 198/617 |

FOREIGN PATENT DOCUMENTS

| | | | | |
|---|---|---|---|---|
| DE | 1006292 | B | 4/1957 | |
| DE | WO 2010060487 | A1 * | 6/2010 | B65G 47/847 |
| DE | WO 2010066217 | A1 * | 6/2010 | B29C 49/4205 |
| DE | 102009017109 | A1 | 10/2010 | |
| EP | 1908725 | A1 | 4/2008 | |
| EP | 2221272 | A2 | 8/2010 | |
| GB | 793276 | A | 4/1958 | |
| WO | WO-2004009484 | A1 | 1/2004 | |

* cited by examiner

CLOSING TOOL

CROSS-REFERENCE TO RELATED APPLICATION

The present application claims the benefit of priority of German Application No. 102011005306.9, filed Mar. 9, 2011. The entire text of the priority application is incorporated herein by reference in its entirety.

FIELD OF THE DISCLOSURE

The disclosure relates to a closing tool of the type used in beverage bottling operations.

BACKGROUND

A closing tool of this type is known from WO 2004/009484. The known closing tool comprises a gripping device formed of a plurality of gripping segments which are grouped around a center line in a circular fashion. In use, the center line coincides with the center line of the container. The gripping segments are capable of approaching and moving away from the center line to a limited extent. This embodiment is to compensate for small tolerances which may appear on a regular basis, even if the production of the closures is carried out with utmost care, so as to reduce the error rate of closures that cannot be screwed on. To this end, the gripping segments are received in a holder in a manner radially displaceable towards the center line, and are loaded by springs in the direction of their closing position. One of the springs is placed around the outer circumference of the gripping segments in the form of an O-ring and presses the gripping segments towards the center line. Another spring acts axially towards the center line and presses the gripping segments against a holding plate provided on the lower side of the closing tool so as to produce an increased friction. However, the opening force of the gripping segments to pick up the closure has to be applied as the closing tool is pressed onto the closure in order to pick it up. The closing tool is pressed onto the closure from above. At the same time, a beveled intake on the gripping segments ensures that the closure can force the gripping segments apart in the radial direction, both against the force of the annular spring and the frictional force on the support plate, until the closure abuts against a stop inside the tool. Both the O-ring spring and the friction on the support plate then ensure that the gripping segments do not drift apart more, allowing the closure to be retained. The load margin of an O-ring is limited, however, so that only small differences in the closure sizes can be covered.

SUMMARY OF THE DISCLOSURE

Thus, the disclosure has as one aspect to render a closing tool for a closing machine for placing a closure on a container universally usable.

The magnetic actuator employed in accordance with the disclosure strongly increases the tolerance range to be coped with by the gripping device, namely in view of dimensions/tolerances and in view of contour or in view of mechanical strength.

Preferably, the gripping device according to the disclosure is provided with gripping members which are movable towards each other.

The gripping members may be pivotable about an axis so as to carry out gripping movements and releasing movements, whereby the gripper's travel for correctly gripping the closure is not limited to the actual dimensions of the closure because the closure need not open the gripper. Furthermore, the operation of the closing tool according to the disclosure is more gentle because the gripping (picking) takes place without friction between the closure and the gripping device, and the opening force of the gripping device need not be applied by the closure.

Within the framework of the physical principles (unlike poles attract each other, like poles repel each other) there exist the most different technical solutions for the magnetic actuator. For example, the magnets of the magnetic actuator may be changed from a position with like poles opposing each other into a position with unlike poles opposing each other by means of a relative displacement or rotational movements.

In one embodiment the gripping members are arranged circularly about a center line and are mounted pivotably about a pivot axis, and one magnet of the magnetic actuator is disposed on the gripping member, while the second magnet of the gripping device is fixed to a holder which is movable along the center line in such a way that the gripping device is opened or closed by magnetic attraction and magnetic repulsion. This embodiment has the additional advantage that the closing tool can thus be easily equipped for an aseptic operation, wherein merely the holder is received in a sealed sleeve (pervious to the magnetic field) so that a contamination of the aseptically held closing tool from the drive side (screwing and stroke movements) is prevented.

A particularly simple construction is obtained if the gripping members are arranged in a holder to be radially displaceable and the magnets of the magnetic actuator are arranged around the gripping segments distributed to two concentric circles.

In addition to the magnetic actuation of the gripping device, also other necessary movements of the closing tool can, at least partially, be generated by magnetic force, e.g. a stroke movement towards and away from the container, but also a screwing movement.

Preferably there are possibilities that allow the adjustment of the magnetic force so as to account for different mechanical strengths of the closures.

BRIEF DESCRIPTION OF THE DRAWINGS

Embodiments of the disclosure are explained in more detail below by means of the drawings. In the drawings.

DETAILED DESCRIPTION OF THE PREFERRED EMBODIMENT

Figure 1:
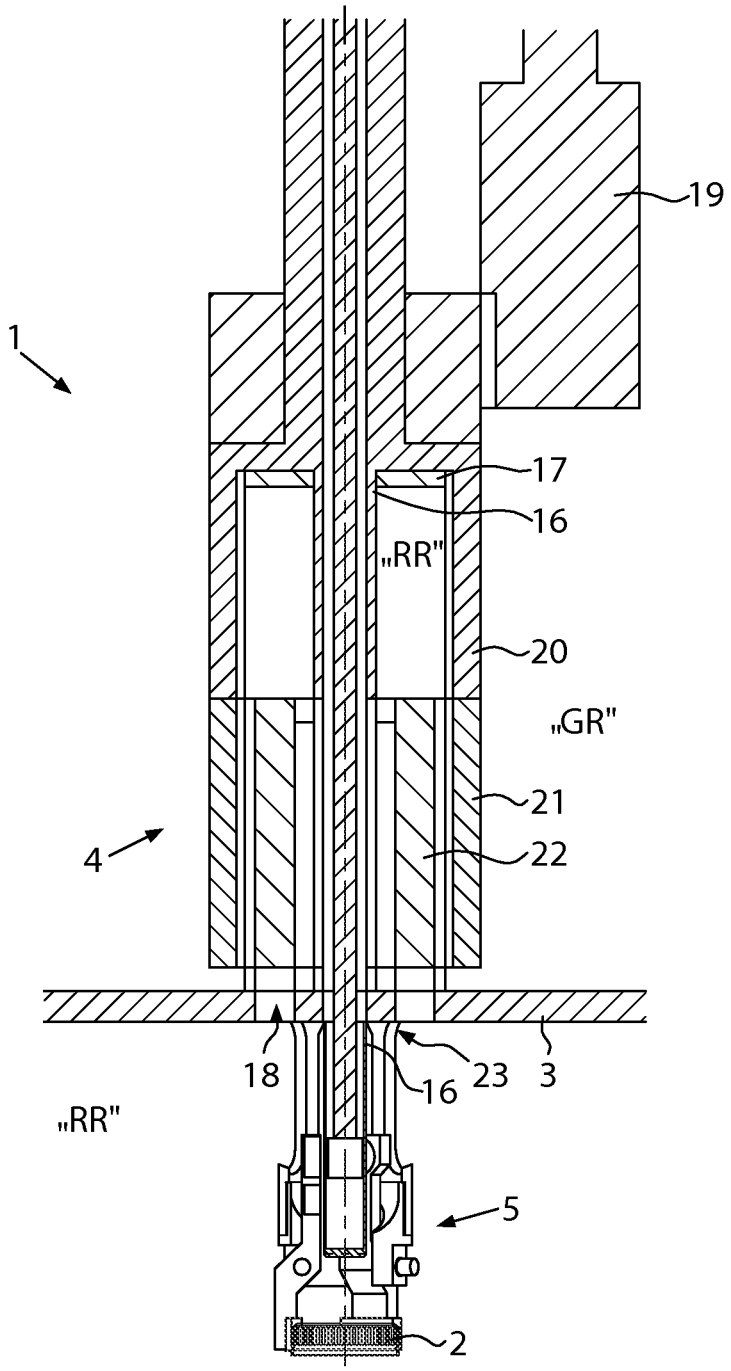
FIG. 1 shows a longitudinal section through a closing element of a closing device comprising a closing tool according to the disclosure.

FIG. 1 shows in a schematic view and in a longitudinal section a closing unit 1 of a closing machine for closing non-illustrated containers with a closure 2. The closing unit 1 according to the illustrated embodiment is designed for aseptic operation, and comprises a partition wall 3 of the closing machine which separates a clean room area RR from a gray room GR. The partition wall 3 divides the closing unit 1 into a drive part 4 and a closing tool 5.

Figure 2:
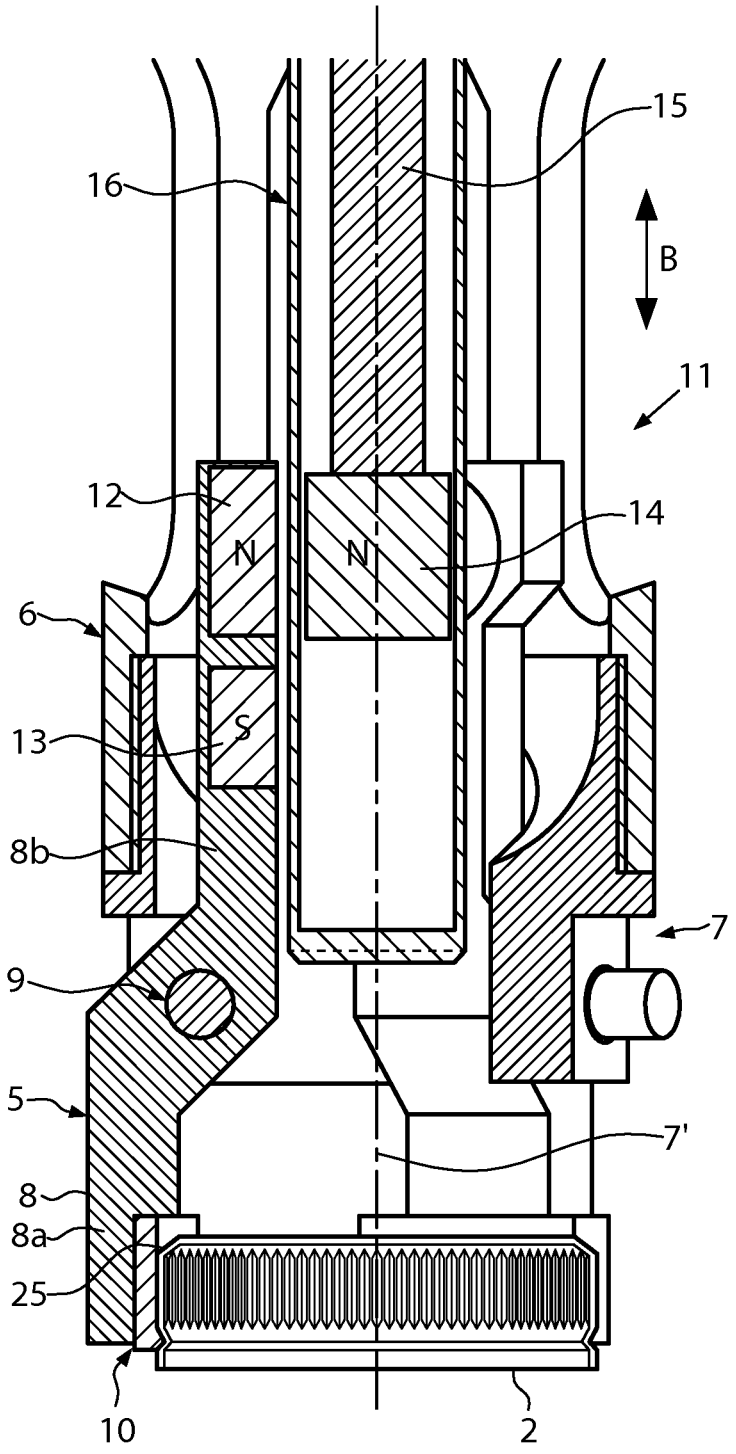
FIG. 2 shows an enlarged view of the closing tool of FIG. 1.

As can also be seen in conjunction with FIG. 2, the tool 5 comprises a case 6 in which a gripping device 7 is accommodated. Preferably, the gripping device 7 is accommodated in the case 6 to be exchangeable and can be exchanged for the purpose of handling different closures. In particular, if the design is for an aseptic operation, these components are mounted free from gaps and in a sealed manner.

In the embodiment as illustrated, the gripping device 7 comprises a plurality of gripping members 8 in the form of gripping segments, which are grouped around the center line 7' of the gripping device 7. The term "gripping member" covers any structure capable of gripping and retaining the closure 2.

Each gripping member 8 is pivotable about a substantially horizontal rotation axis 9 in the form of a bolt or something of that kind into a gripping position so as to hold the closure, and a releasing position so as to release the closure. The rotation axis 9 subdivides the gripping member 8 into a lower arm 8*a* , which is provided with gripping elements 10, such as engagement projections or corrugations or something of that kind, by means of which the closure 2 can be held securely, and an upper arm 8*b* acted on by a magnetic actuator 11 for pivoting the gripping members 8 about the rotation axis 9 and, thus, for opening and closing the gripping device 7. The magnetic actuator 11 preferably comprises permanent magnets and is based on the known physical principles that like poles of permanent magnets repel each other and unlike poles attract each other. The magnetic actuator 11 in the illustrated embodiment is realized in a linear combination, with a first magnet 12 and a second magnet 13 being located in an axial direction side by side along the center line 7' on the second arm 8*b* of the gripping member 8. The two magnets are oriented such that they are pointing with different poles to the center line 7'. In the embodiment shown, the upper magnet 12 points with its north pole and the lower magnet 13 with its south pole to the center line 7'. The magnetic actuator 11 further comprises a third magnet 14, which is responsible for all gripping members 8, however. The third magnet 14 is preferably an annular magnet, whose outer circumference includes the north pole. The third magnet 14 is fixed to a holder 15 in the form of a holding rod, which runs coaxially with respect to the center line 7', and is movable in the direction of actuation B from its position opposite the first magnet 12, as shown in FIG. 2, to a position opposite the second magnet 13, and back. If the third magnet 14 is positioned at the level of the first magnets 12 of all gripping members 8, the gripping members 8 are pivoted by repulsion into the closed position shown in FIG. 2, wherein the gripped closure 2 can be retained and screwed on. If this has been accomplished, the third magnet 14 moves downwards along the center line 7' until it is located opposite the second magnets 13 of all gripping members 8. Now, the attraction takes place, which pivots the gripping members 8 about the rotation axis 9 into an opened position, in which the closure 2 is released.

This kind of magnetic actuator 11 is suited particularly for the clean room embodiment or aseptic embodiment according to FIG. 1, wherein merely the holding rod 15 with the third magnet 14 is accommodated in a closed, sleeve-like ejector rod 16 (pervious to magnetic fields). This ejector rod 16 is easy to seal by means of a sleeve 17, which is fixed all around a through opening 18 through the partition wall 3 in a sealing manner, and on the bottom of which the ejector rod 16 is fixed, again by sealing the through opening. The driving movement with respect to the screwing rotation can be transmitted, for example by means of a gearwheel coupling 19, to a rotating sleeve 20. By means of a magnetic actuator in the form of a magnetic coupling 21 the rotating sleeve 20 transmits the rotation to an inner sleeve 22 on which the tool 5 is mounted (preferably releasably by a corresponding coupling 23).

The stroke movement to the tool 5 for opening and closing the gripping members 8 is likewise accomplished by the magnetic coupling 21, with the stroke movement only being transmitted during the screwing movement. The movement of the holding rod 15 is carried out separately from the stroke movement and independently of the drive system thereof.

The drive movements may also be generated by other means, however, e.g. pneumatically, electrically or electromagnetically.

On the lower side of the gripping members, which is opposite the closure 2, stops 25 for the insertion depth of the closure 2 into the tool may be provided, preferably in an exchangeable manner.

Figure 3:
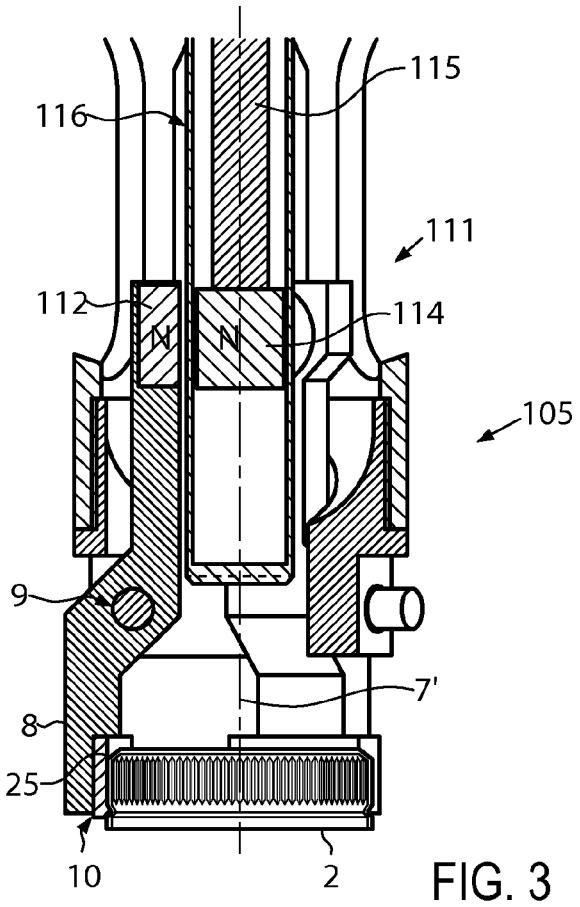
FIG. 3 shows a modified embodiment of the closing tool of FIG. 2.
Figure 4:
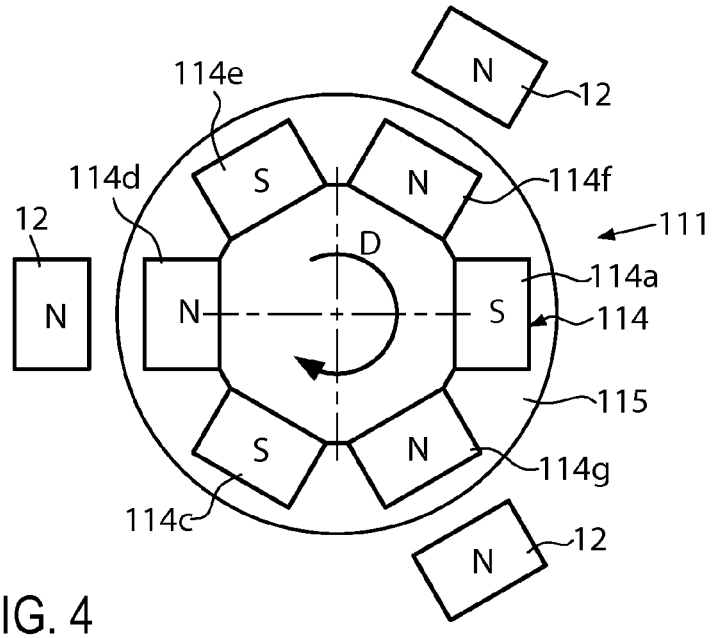
FIG. 4 shows the magnetic actuator of the closing tool of FIG. 3.

FIGS. 3 and 4 show a modified embodiment of a closing tool 105, which differs from the embodiment of FIGS. 1 and 2 merely by another arrangement of the magnets of the magnetic actuator 111. In the closing tool 105, the holding rod 115 accommodated in the ejector rod 116 comprises the magnet assembly 114 as shown in FIG. 4, whereof a plurality of magnets 114*a* to 114*f* are arranged circularly and with alternating polarities about the center line 7', so that a south pole and a north pole, respectively, are pointing alternately to the outside, i.e. away from the center line 7'.

The gripping members 8 in the form of gripping segments are here merely provided with the first magnets 12, which are arranged on all three segments, pointing with the same polarities to the inside, i.e. towards the center line 7'. In the embodiment illustrated this is the north pole.

In this embodiment the holding rod 15 is not longitudinally displaced, axially relative to the center line 7', but is rotated about the center line 7', as is shown by arrow D. Thus, after each ⅙ rotation, another pole is brought into a position opposite the first magnets 12 on the gripping segments, wherein, as shown in FIG. 4, firstly a repulsion takes place so as to close the gripping device, while an attraction takes place in the next step so as to open the gripping segments. This embodiment of the closing tool 105, too, is clean room compatible and aseptically suitable.

Figure 5:
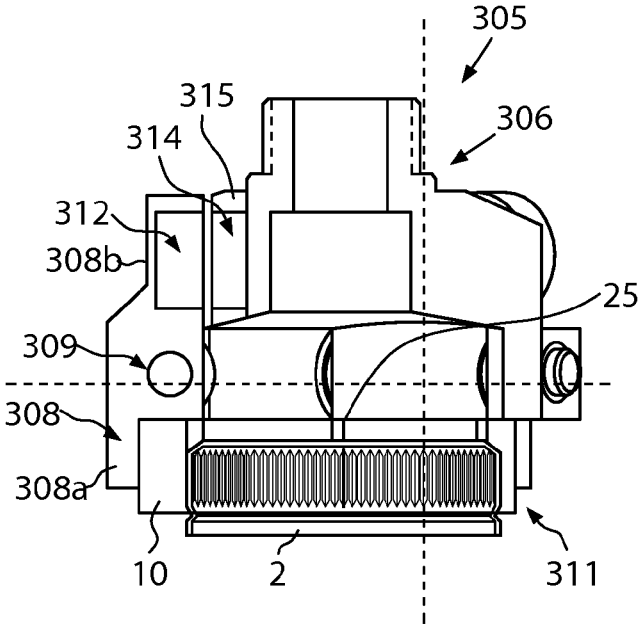
FIG. 5 shows a longitudinal section through another embodiment of a closing tool according to the disclosure.

FIG. 5 shows another embodiment of a closing tool 305 according to the disclosure, exhibiting features of the two preceding embodiments. Like or comparable components are designated with reference numbers increased by 300, and are not explained again. The closing tool 305 comprises a plurality of gripping segments 308, which are pivotable about a pivot axis 309. The so formed lower arm 308*a* is provided with the gripping members 10, and the upper arm 308*b* carries a magnet 312. The counter-magnet(s) 314 are fixed to a swivel 315 of the holder 306, so as to achieve the interaction already described above between attraction for opening and repulsion for closing the gripping device 311.

Figure 6:
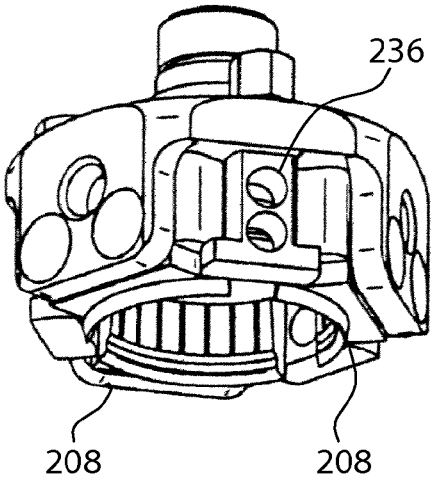
FIG. 6 shows a perspective view of another embodiment of a closing tool according to the disclosure.
Figure 7:
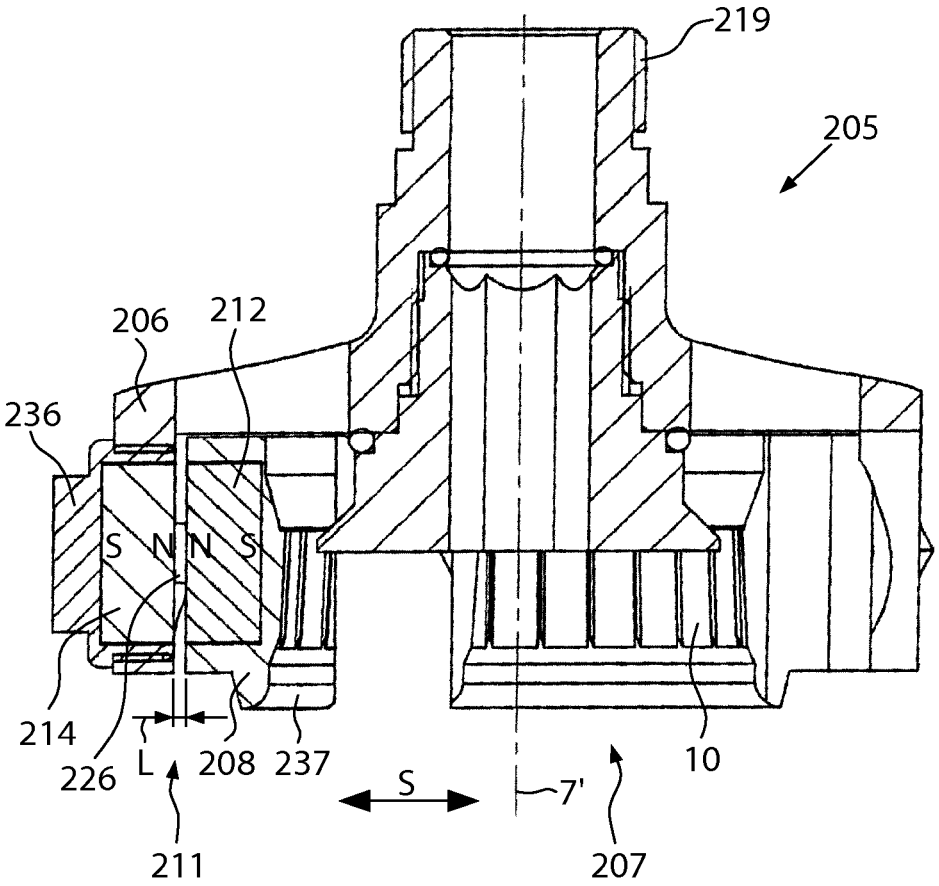
FIG. 7 shows a longitudinal section through the embodiment of FIG. 6.

FIGS. 6 and 7 show another embodiment of a closing tool 205 according to the disclosure, which is characterized by a simple design. The closing tool 205 comprises a gripping device 207 with a plurality of gripping members 208 in the form of gripping segments, which are circularly arranged about the center line 7'. The gripping members 208 are displaceable in the direction of the double arrow S towards the center line 7' and away from the center line 7', however, which may be obtained by suitable guides, such as the guide rod 226 shown. Tool 205, too, comprises a magnetic actuator 211 with first magnets 212 and opposite (third) magnets 214, which are arranged on concentric circles about the center line 7'.

Like in the preceding embodiments, the closing tool 205 may be designed to move the gripping members 208 into a gripping position and a release position with respect to the closure 2, this time by a displacement, which is achieved by mounting the magnets 214 in the circle about the center line 7' with alternating polarities, respectively, so that by rotating the holder 206 different polarities are opposite the magnets 212.

It is preferred, however, that the magnets 214, 212 are stationary and mounted in such a way that like polarities are positioned opposite each other so as to generate a repulsion. Thus, the magnetic force and gap L are adjusted in such a way that the gripping members 208 surround a space about the center line 7' which is at least equal to, preferably smaller than the diameter of the closure to be picked up. The gripping members 208 are, and this is of particular importance, provided with beveled intakes 37 on their lower sides, so that the closure forces the gripping members 208 apart against the repulsion force of the magnets 212, 214 as the tool 205 is placed down, thereby applying the holding force as the closure 2 is handled and as the closure 2 is put on. When the tool 205 is withdrawn from the closed container the gripping members 208 return into their initial position as a result of the repulsion force of the magnets 212, 214.

The closing tool 205 further comprises on its holder 206 a driving gear tooth system 219 for producing the screwing movement.

Due to the mounting in the modified embodiment as illustrated, and also in the embodiments described, there may be a possibility to adjust the magnetic force. This may be accomplished, for example, by varying the distances between the mutually influencing magnets of the magnetic actuator. In the embodiment shown, the magnets 214 are each received in holders 236, which are fixed to holder 206 in an individually adjustable manner, so that the gap L between the magnets 212, 214 along the guide rod 226 can be adjusted.

In a modification of the embodiments described and illustrated the closing tools according to the disclosure may also be designed with other gripping members, e.g. gripper arms, which have a greater distance between them. Also, a special embodiment for special shapes of closures is possible. Finally, details in the figures may be interchanged. For example, the depth-control stops for the closures for the depth and/or the adjustability of the magnetic force may be provided in all embodiments.

The invention claimed is:

1. A closing tool for a closing machine for placing a closure on a container, the closing tool comprising:

a gripping device comprising at least three gripping members grouped around a center line of the gripping device, each gripping member of the at least three gripping members being pivotably mounted about a pivot axis which subdivides the gripping member into a first arm and a second arm, the first arm being configured to grip the closure during a gripping operation; and a first magnet disposed on the second arm of at least one gripping member of the at least three gripping members such that the first magnet and the second arm pivot together about the pivot axis during the gripping operation;

a second magnet disposed on the second arm of the at least one gripping member of the at least three gripping members such that the second magnet and the second arm pivot together about the pivot axis during the gripping operation, wherein the second magnet has a different polarity than the first magnet; and a third magnet linearly translatable along the center line between the at least three gripping members.

2. A closing tool for a closing machine for placing a closure on a container, the closing tool comprising:

a gripping device comprising at least three gripping members grouped around a center line of the gripping device and configured to grip the closure, each gripping member of the at least three gripping members being linearly translatable along a radial line extending from the center line; and a first plurality of magnets disposed on the at least three gripping members and a second plurality of stationary magnets circularly arranged about the center line, the second plurality of magnets being concentrically arranged with the first plurality of magnets and mounted such that like polarities are positioned opposite each other so as to generate a repulsion of the first plurality of the magnets towards the center line; and a gap between the first plurality of magnets and the second plurality of magnets, the gap being adjustable such that the gripping members surround a space about the center line which is smaller than a diameter of the closure to be picked up.

3. The closing tool of claim 2, the second plurality of magnets being rotatable relative to the first plurality of magnets.

4. A closing tool for a closing machine for placing a closure on a container, the closing tool comprising:

a gripping device comprising at least three gripping members grouped around a center line of the gripping device, each gripping member of the at least three gripping members being pivotably mounted about a pivot axis which subdivides the gripping member into a first arm and a second arm, the first arm being configured to a grip the closure during a gripping operation;

a first plurality of magnets, each magnet of the first plurality of magnets being disposed on the second arm of at least one gripping member of the at least three gripping members such that the magnet and the second arm pivot together about the pivot axis during the gripping operation; and a second plurality of magnets being concentrically rotatable relative to the first plurality of magnets, the second plurality of magnets being arranged in a circle about the center line with alternating polarities.

* * * * *